US005219245A

United States Patent [19]

Chin-Yee

[11] Patent Number: 5,219,245

[45] Date of Patent: Jun. 15, 1993

[54] RECOVERY SYSTEM FOR A SUBMERGED INSTRUMENT

[75] Inventor: Mark Chin-Yee, Darmouth, Canada

[73] Assignee: Her Majesty the Queen in right of Canada, as represented by the Department of Fisheries and Oceans, Ottawa, Canada

[21] Appl. No.: 825,041

[22] Filed: Jan. 24, 1992

[30] Foreign Application Priority Data

Dec. 10, 1991 [CA] Canada ..... 2057361

[51] Int. Cl.[5] ..... B63C 11/00

[52] U.S. Cl. ..... 405/191; 405/188; 441/2; 441/23

[58] Field of Search ..... 405/190, 191; 294/65.5, 294/66.1, 66.2; 441/1, 2, 11, 23, 6, 24, 33; 114/326, 328

[56] References Cited

U.S. PATENT DOCUMENTS

| | | | |
|---|---|---|---|
| 3,316,514 | 4/1967 | Radus et al. | 335/291 |
| 3,367,297 | 2/1968 | Berger | 114/326 |
| 3,499,411 | 3/1970 | Savoie | 441/6 X |
| 3,705,431 | 12/1972 | Bell et al. | 9/8 |
| 3,722,014 | 3/1973 | Hill et al. | 441/2 |
| 3,858,166 | 12/1974 | Hammond | 340/5 |
| 4,262,379 | 4/1981 | Jankiewicz | 9/8 |
| 4,278,362 | 7/1981 | Scherrer | 405/191 |
| 4,664,559 | 5/1987 | Berrang | 405/224 |
| 4,731,036 | 3/1988 | Ulf | 441/23 X |
| 5,022,013 | 6/1991 | Dalton et al. | 441/2 X |
| 5,100,353 | 3/1992 | Domborwski et al. | 441/23 X |

OTHER PUBLICATIONS

"Permanent Magnets in Theory and Practice" 2nd Ed. M. McCaig & A. G. Clegg pp. 254–259 (258).

*Primary Examiner*—Dennis L. Taylor
*Attorney, Agent, or Firm*—Ronald G. Bitner

[57] ABSTRACT

A recovery system for a submerged instrument that includes a buoyant member and an electrically promoted magnetic flux diversion device comprising a pair of pole pieces, a permanent magnet disposed substantially centrally between said pole pieces, and a release plate comprising ferromagnetic material bridging one end of said pole pieces, the pole pieces and permanent magnet forming tow flux paths with the metal release plate forming a portion of one of said flux paths. A control winding associated with the pole pieces are disposed for producing a momentary magnetic field opposite to that of the permanent magnet to divert the flux path from the path that includes the release plate to the other flux path. A remotely activated electrical pulse to the control winding diverts the flux path and releases the release plate form the pole pieces allowing the marker buoy to rise to the surface for recovery of instrument or device to which the buoy is attached.

8 Claims, 1 Drawing Sheet

RECOVERY SYSTEM FOR A SUBMERGED INSTRUMENT

FIELD OF THE INVENTION

This invention relates to a recovery system for a submerged instrument, and particularly for the recovery of scientific instruments from coastal waters.

BACKGROUND OF THE INVENTION

The recovery of small instruments moored in coastal waters has been hampered by uncontrolled factors, due primarily to the marker buoy at the surface. Many instruments are lost because the float becomes entangled in fishermen's gear, or, because the float attracts unwanted attention. Commercially available transponder releases have been used on many moorings which generally operate at greater depths. Most of these devices are heavy, bulky, complex devices, which require preparation by skilled technicians, and not suitable for deployment from the small open boats generally used for near short work. Most of the present devices are also expensive relative to the value of some of the instruments themselves.

U.S. Pat. No. 3,858,166 discloses a device that employs an acoustic signal to trigger a magnetic latch for a buoyant marker. The magnetic latch releases the marker when supplied with a current that neutralizes the magnetic field of the permanent magnetic. To effect release in this manner requires a substantial current for a substantial period of time and hence has a high power requirement relative to the strength of the permanent magnet. To allow use of a relatively small strength magnet, a lever-arm mechanism is employed.

Electrically promoted magnetic flux diversion is a known concept that has been employed in cranes used to move scrap metal. The known device uses a permanent magnet in combination with a control winding that generates a magnetic field with polarity opposite to that of the permanent magnet, when supplied with a electric current, for releasing a load.

U.S. Pat. No. 4,664,559 discloses a remotely operated magnetic release for anchored aquatic instrumentation which includes a geared mechanism for effecting release of the buoyed instrument for recovery.

For the recovery of small instruments moored in coastal waters it is desirable to have a simple, low cost, low powered, maintenance free device without moving parts, that would allow a small tethered buoy or float to rise to the surface when recovery is desired.

SUMMARY OF THE INVENTION

An object of the invention is to provide a system for the recovery of a submerged instrument.

Another object of a specific embodiment of the invention is to provide a marker buoy releasing mechanism that can be made without moving parts and at low cost.

It has been found that simple recovery system for a submerged instrument can be made utilizing a marker buoy release mechanism incorporating the principle of electrically promoted magnetic flux diversion and activated remotely by a trigger device when recovery of an underwater device is desired.

In accordance with the present invention there is provided a recovery system for a submerged instrument comprising: a buoyant member; a buoyant member releasing mechanism comprising an electrically promoted magnetic flux diversion device comprising a pair of pole pieces, a permanent magnet disposed substantially centrally between said pole pieces, and a release plate comprising ferromagnetic material bridging gone end of said pole pieces, said pole pieces and permanent magnet forming two flux paths with said release plate forming a portion of one of said flux paths; guide means allowing axial separation of the release plate from the pole pieces while preventing lateral motion; control winding means associated with the pole pieces for receiving a pulse of electrical current and disposed for producing a momentary magnetic field opposite to that of the permanent magnet to divert the flux path from the path that includes the release plate to the other flux path; current supply means for supplying a pulse of electrical current to said control winding; a mooring device having a weight that exceeds the buoyant force of the buoyant member; means connecting said release plate to the mooring device; and a tether line connected between the release plate and the buoyant member to allow the buoyant member to rise relative to the mooring device upon release from the pole pieces.

DESCRIPTION OF THE PREFERRED EMBODIMENTS

Figure 1:
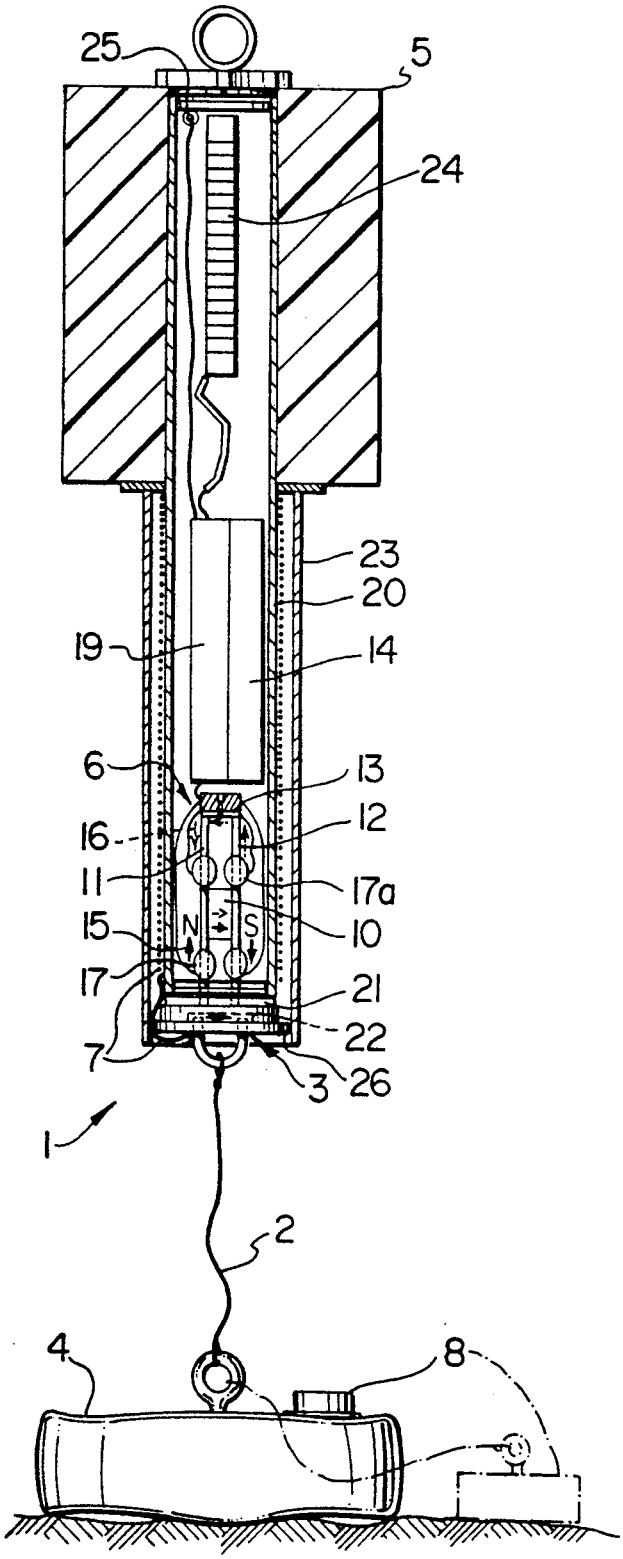
FIG. 1 is a schematic view illustrating a system according to the present invention moored at the bottom of a body of water.
Figure 2:
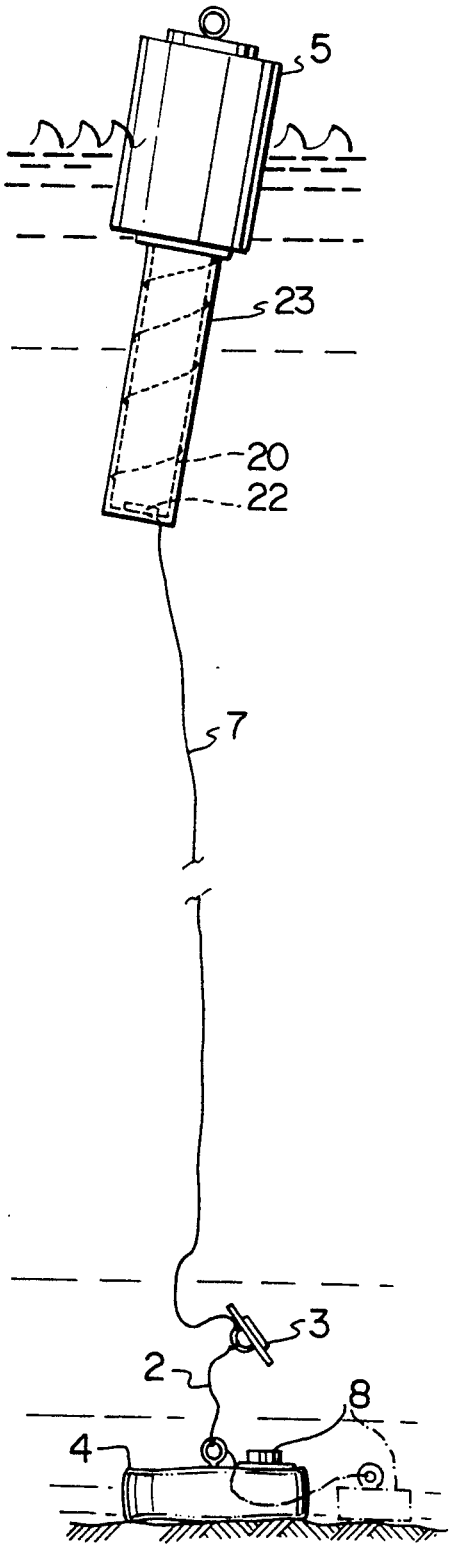
FIG. 2 is a schematic view showing the system of FIG. 1 with the marker buoy released for recovery.

Referring to FIG. 1, the system of the present invention comprises an assembly 1 moored at the bottom of a body of water by means of a first line 2 attached to a metal release plate 3 and a suitable anchor 4. The assembly includes a buoyant member 5 and a buoyant member releasing mechanism incorporating an electrically promoted magnetic flux diversion device 6. A second line 7 interconnects the release plate 3 with the buoyant member 5. The instrument or instruments 8 to be submerged can be connected with the assembly by any suitable means.

With reference to FIGS. 1, the electrically promoted magnetic flux diversion device 6 comprises a permanent magnet 10, a pair of pole pieces 11 and 12, the release plate 3, and control winding 17. The permanent magnet 10 is disposed between the pole pieces 11 and 12. The release plate 3 bridges one end of the pole pieces 11 and 12. The opposite end of the pole pieces is shown connected by end pierce 13. The components are arranged to form a first magnetic flux path 15 and a second flux path 16. All components forming the first and second flux paths are made of ferromagnetic material. The metal release plate 3 completes the flux path 15 between the pole pieces 11 and 12. One or more control windings 17, and optionally 17*a*, are shown associated with the pole pieces 11 and 12, in a manner that upon receiving an electrical current form current supply means 14, produce a magnetic field opposite to that of the permanent magneto to switch the magnetic flux path to the path 16.

The release plate 3 is releasably retained by the permanent magnet through the pole pieces 11 and 12 when the flux path is switched to flux path 15.

Suitable trigger means 19 controls delivery of electrical current from the current supply means 14 to the control winding 17. The trigger means may comprise a receiver responsive to a electromagnetic signal to antenna 24 from a suitable transmitter. Alternatively, the trigger means may be activated by an acoustic signal from a transponder, or a timer.

The control winding 17 may be used to initially arm the device by directing the flux path to flux path 15 by momentarily supplying current in a direction opposite to that used for release. A LED indicator 25 may be used to indicate the status of the device.

The assembly is shown to include a housing that comprises a tubular portion 20 and an end portion 21 which will preferably include sealing means to form a watertight enclosure for the electrical circuitry, signal receiver and power supply. The end portion 21 includes a recess 22 which defines guide means allowing axial separation of the release plate from the pole pieces while preventing lateral motion. The guide means maximizes the holding effect between the magnet and the release plate by preventing lateral sliding motion of the release plate relative to the pole pieces. The end portion 21 must be made of non-magnetic material to avoid short-circuiting the flux path through the release plate. The pole pieces 11 and 12 penetrate the end portion 21 to provide a flux path to the release plate 3.

FIG. 1 shows the tether line 7 sorted on the housing 20 by being wound around it. An outer tubular covering 23 enclosing and spaced from the housing defines an annular protective storage space for the line 7. The release plate 3 includes retention means 26 for retaining the line 7 between the housing 20 and covering 23 until the release plate 3 is released.

In operation, the device is initially armed by placing the release plate 3 in position against the pole pieces 11 and 12, as shown in FIG. 1 and arranging for the flux path to be directed to flux path 15, which as indicated above can be achieved by supplying current to the control windings in the appropriate direction. With the magnetic flux path directed through flux path 15, the metal release plate 3, which forms portion of the flux path, is held in position. The assembly, armed as described above, along with the instrument 8, is deployed to rest on the sea floor as shown in FIG. 1. For recovery, the trigger means 19 is activated to allow conduction of an electrical pulse from current supply means 14 to the control winding 17. The electrical pulse through the control winding 17 produces a momentary magnetic field opposite to that of the permanent magnet to divert the magnetic field from flux path 15 to flux path 16 deactivating the holding force of the permanent magnet 10 on release plate 3. Release of the release plate 3 from the pole pieces allows the buoyant member 5 to rise. The buoyant member 5 remains attached to the mooring device 4 by means of line ether 7 which unwinds form the surface of the inner housing 20 when the release plate, along with the line retention means 26, is detached, as is shown in FIG. 1. The buoyant member 5 rises to the surface marking the position of the instrument for recovery, and presenting a tether line from the mooring to the surface.

It should be noted that the present flux diversion system differs from a more conventional magnetic latching system which requires supplying a current that neutralizes the magnetic field for a sustained, relatively long period of time to ensure separation of the magnetically held component.

Various approaches may be sued to send an electrical signal to the control winding 17 remotely. Since the current required to divert the magnetic field and release the marker buoy need only be applied for a brief period, the required energy can be conveniently supplied from a compact battery pack with readily available batteries. As illustrated in FIG. 1, the electrical signal can be controlled by trigger mean that includes a receiver response to an electromagnetic signal from a remote transmitter. Alternatively, the electrical signal can controlled with the use of a timer or an acoustic transponder.

It will be apparent that the present invention could be used in various marine applications such as ocean sciences, the fishing industry, agriculture, etc.

What is claimed is:

1. A recovery system for a submerged instrument comprising:
   - a buoyant member;
   - a buoyant member releasing mechanism comprising an electrically promoted magnetic flux diversion device comprising a pair of pole pieces, a permanent magnet disposed between said pole pieces, and a release plate comprising ferromagnetic material bridging one end of said pole pieces, said pole pieces and permanent magnet forming two flux paths with said release plate forming a portion of one of said flux paths;
   - guide means allowing axial separation of the release plate from the pole pieces while preventing lateral motion;
   - control winding means associated with the pole pieces for receiving a pulse of electrical current and disposed for producing a momentary magnetic field opposite to that of the permanent magnet to divert the flux path from the path that includes the release plate to the other flux path;
   - current supply means for supplying a pulse of electrical current to said control winding;
   - a mooring device having a weight that exceeds the buoyant force of the buoyant member;
   - means connecting said release plate to the mooring device; and
   - a tether line connected between the release plate and the buoyant member to allow the buoyant member to rise relative to the mooring device upon release from the pole pieces.

2. The system of claim 1 including trigger means for controlling delivery of electrical current from the current supply means to the control winding.

3. The system of claim 2 in which said trigger mean includes a receiver responsive to a electromagnetic signal form a transmitter.

4. The system of claim 2 in which said trigger means comprises a timer.

5. The system of claim 1 including a housing for enclosing the electrically promoted magnetic flux diversion device.

6. The system of claim 5 wherein the housing includes a recess for receiving the release plate, said recess defining said guide means for the release plate.

7. The system of claim 5 including an outer tubular covering enclosing and spaced from the housing defining an annular protective storage space for the tether line.

8. The system of claim 7 wherein the release plate includes retention means for retaining the tether line between the housing and covering until the release plate is released.

* * * * *